United States Patent [19]

Meyer et al.

[11] Patent Number: 4,685,936

[45] **Date of Patent: * Aug. 11, 1987**

[54] METHOD OF VARYING RHEOLOGY CHARACTERISTICS OF NOVEL COAL DERIVED FUEL SYSTEM

[75] Inventors: Edmond G. Meyer, Laramie, Wyo.; Lee G. Meyer, Englewood, Colo.

[73] Assignee: Carbon Fuels Corporation, Englewood, Colo.

[ * ] Notice: The portion of the term of this patent subsequent to Oct. 9, 2001 has been disclaimed.

[21] Appl. No.: 658,880

[22] Filed: Oct. 9, 1984

Related U.S. Application Data

[63] Continuation-in-part of Ser. No. 427,937, Sep. 29, 1982, Pat. No. 4,475,924, which is a continuation-in-part of Ser. No. 247,382, Mar. 24, 1981, abandoned.

[51] Int. Cl.[4] ..... C10L 1/32

[52] U.S. Cl. ..... 44/51; 44/15 R

[58] Field of Search ..... 44/51, 1 SR

[56] References Cited

U.S. PATENT DOCUMENTS

| | | | |
|---|---|---|---|
| 4,208,251 | 6/1980 | Rasmussen | 44/51 |
| 4,443,230 | 4/1984 | Stellaccio | 48/197 R |
| 4,475,924 | 10/1984 | Meyer | 44/51 |
| 4,490,156 | 12/1984 | Marion et al. | 48/61 |
| 4,491,456 | 1/1985 | Schlinger | 48/197 R |

*Primary Examiner*—Jacqueline V. Howard

*Attorney, Agent, or Firm*—Lee G. Meyer

[57] ABSTRACT

The rheology of a fluidic, combustible liquid/solid slurried fuel system derived in substantial part from the pyrolytic destructive thermal distillation of coal in the absence of oxygen and which is comprised of a pipeline transportable, nonpolluting fuel composition is varied by changing hydropyrolysis conditions to alter the viscosity of the liquid. Likewise, the viscosity of the liquid organic fraction which serves as the slurry medium or as a feedstock can be further varied by admixture with low boiling alcohols.

19 Claims, No Drawings

METHOD OF VARYING RHEOLOGY CHARACTERISTICS OF NOVEL COAL DERIVED FUEL SYSTEM

TECHNICAL FIELD

This application is a continuation-in-part of U.S. patent application Ser. No. 427,937 filed Sept. 29, 1982, now U.S. Pat. No. 4,475,924 issued Oct. 9, 1984 which is a continuation-in-part of U.S. patent application Ser. No. 247,382 filed Mar. 24, 1981, now abandoned. The parent application which is incorporated in its entirety by reference as if it were completely set out herein, discloses a transportable fuel system as well as completely combustible, transportable fuel compositions derived from coal, which compositions contain particulate coal char, and methods for making such a system. The parent application further discloses that the pyrolysis and the slurrying process may be altered to vary rheological characteristics of the slurry.

The instant invention relates to an improved method of varying the rheology characteristics of fluidic transportable fuel systems and fuel compositions to enhance pumpability and tailor the slurry characteristics for particular end uses. The fuel systems are completely combustible and contain particulate coal char derived from solid carbonaceous fuels such as coal, lignite and lower rank coals, and the like. More particularly, this invention relates to a method of preparing the high energy, non-polluting, transportable fluidic fuel systems, which are derived substantially from coal, to tailor slurry rheology characteristics to specific transportation means as well as particular end-use applications.

BACKGROUND ART

In the parent application it was disclosed that coal could be subjected to pyrolysis or hydropyrolysis under certain conditions to produce a particulate char and a liquid organic fraction which is rich in hydrocarbons, completely combustible, can be beneficiated and can serve as a liquid phase for a carbonaceous slurry fuel system. Thus the viscosity, pumpability and stability of the slurry when the char is admixed with the liquid organic fraction is a function of pyrolysis process parameters, the means of slurrying, the loading and the stabilizers used as well as the physical aspects of the solid constituent.

As set forth in the parent application, the feasibility of economically transporting slurry fuel is predicated upon its rheology. Rheology is the study of deformation and flow of matter. It is concerned primarily with the mechanics of deformable liquids or solids. The study of rheology is complicated by nonideal behavior. A liquid whose viscosity decreases with increasing stress (such as increased rate of flow or of stirring) is called pseudoplastic; if the viscosity increases with the stress, the liquid is dilatant. An ideal elastic solid shows no shear at any shearing stress, but actual solids will have a yield point beyond which flow begins to occur. A solid is known as a Bingham plastic if, once flow takes place, the rate of shear is proportional to the shearing stress in excess of the yield value.

The measured viscosity of a system is given by a ratio as a function of shear. A Newtonian fluid is one whose viscosity coefficient is independent of shear. Thus, Bingham and pseudoplastic solids as well as non-Newtonian liquids have viscosities that are dependent on the rate of shear.

The situation becomes considerably more complicated since the measured viscosity can vary with time as well as with shearing stress. A liquid which becomes more fluid with increasing time of flow is said to be thixotropic, while if the opposite is true, the liquid is said to exhibit rheopexy. Examples of these types of behavior are as follows: Gases and pure single-phase liquids exhibit Newtonian viscosity, while suspensions, slurries and emulsions are apt to show dilatant behavior—a common example being that of a thick starch paste. Household paints are often pseudoplastic so as to brush easily but not run; the same is true for printing inks. Some gels are thixotropic—they will liquify on shaking.

In most prior art slurries, the rheology characteristics could not be varied greatly to accomodate certain end-use applications or transportation systems. For example, the rheology of water/coal or $CO_2$/ coal systems is a function primarily of loading. Even with alcohol or oil media, variance of the liquid viscosity is not practical.

As disclosed in the parent application, the novel fuel system exhibits some very advantageous rheology properties and, more importantly, the means for varying these rheology characteristics for end-use application or a particular pumping system. In many cases, it is pseudoplastic and even thixotropic. This allows storage of the slurry which is readily pumpable. These rheology characteristics are a function of the characteristics of the liquid, including its viscosity, the characteristics of the solid, including its shape, and the interaction of stabilizers. It will be realized that the rheology of any given slurry admixture is empirical. However, the instant invention is concerned with efficient methods of varying the rheology of the slurry to tailor the slurry to specific transport systems as well as end-use applications.

DISCLOSURE OF THE INVENTION

It has been discovered that, by varying the process parameters during pyrolysis and/or treating the solids and liquids subsequent to the pyrolysis, not only can the rheology of the slurry be tailored to specific transportation systems but the fuel itself can be varied to accomodate certain end-uses.

In the broad aspect of the invention, the rheology characteristics of the liquid-solid mixture which includes a particulate coal char portion dispersed in a liquid organic fraction can be advantageously altered by varying the process parameters during hydropyrolysis of the coal in the presence of water, hydrogen, a hydrogen donor or mixtures thereof. In a further aspect, at least a portion of the liquid organic fraction derived from the hydropyrolysis is further hydrogenated to enhance the viscosity characteristics of the liquid. In accordance with the method of the instant invention, a fuel composition having advantageous rheology characteristics which can be varied to fit certain transportation media as well as modified for end-use applications is produced by subjecting coal to hydropyrolysis to produce a particulate coal char which is admixed in suitable proportions with a liquid organic fraction to produce a solid/liquid fluidic mixture, i.e., a slurry which is transportable using existing pipelines.

In a further aspect, the particulate coal char can be admixed with raw coal, upgraded coal, petroleum coke and the like to yield a high BTU, reduced pollutant fuel for char- or coal-fired combustion devices. Likewise, the liquid hydrocarbon can be used itself as a fuel or admixed with a liquid petroleum distillate or alcohols, such as those produced from grains or the synthesis of coal, in order to vary the rheology characteristics of the liquid fuel.

In accordance with the invention, the rheological characteristics can be varied by varying the viscosity of the organic liquid and the size and distribution of the solid carbonaceous material in the slurry as well by coating the solid to reduce liquid absorption. The char produced by hydropyrolysis is sized and otherwise mechanically and thermally treated to yield a particulate coal char of a distribution to advantageously effect loading of the solid. The liquid organic fraction obtained from the hydropyrolysis of coal is treated and admixed with the particulate char in proportions so as to form the fluidic, liquid/solid, completely combustible fuel mixture suitable for pipeline transport and combustion directly in combustion systems. In one aspect, the liquid organic fraction is beneficiated to remove sulfur or nitrogen pollutants.

In accordance with another embodiment, the rheology of the slurry is altered by admixing therewith a portion of a lower chain alcohol, which alcohol is preferably produced by well known synthetic methods utilizing coal and water or natural gas. In accordance with a greatly preferred embodiment, the alcohol is produced from the gases liberated in the pyrolysis process, thus producing all the fuel system components from a single, completely self-contained process system.

The utilization of the particulate char allows a high packing of the solid particulate matter for a given fluidity of the mixture, thus allowing high loading without adversely affecting the rheology characteristics. Thus, not only does one obtain the aforementioned advantages, but the energy requirement necessary to pump each BTU of fuel energy is significantly reduced. The slurry composition in many aspects possesses thixotropic characteristics. In a further advantageous embodiment, the char is ground and sized to yield a particulate distribution which is bimodal or trimodal. The use of a bimodal or trimodal particulate char distribution enhances the packing of the solid for a given set of slurry flow characteristics.

In accordance with another embodiment of the instant invention, an amount of pulverized coal is added to the particulate coal char/liquid organic fraction slurry. In accordance with this embodiment, the coal is pulverized so as to provide bimodal or trimodal packing with the char. This improves the combustion characteristics of the slurry in some combustion applications without the expense of processing all the coal by pyrolysis. The amount of coal which is added is effective to improve the combustion characteristics without adversely affecting the beneficial rheological aspects of the particulate coal char/liquid organic material admixture. Addition of coal to the slurry prior to transport is economically attractive in that grinding and sizing facilities at the slurry preparation site already exist.

In addition to the char and the liquid organic fraction, which is a hydrocarbon rich material, the hydropyrolysis produces gaseous products. These gases contain lower chain hydrocarbons, hydrogen, carbon monoxide, and other combustibles as well as ammonia, sulfurous compounds and nitrogenous compounds. The gases are useful for the extraction of marketable by products such as ammonia, and for use as a hydrogen source for hydropyrolysis, as a fuel for use in combustion systems and, most importantly, as a feedstock for the production of lower chain alcohols for use as a hydrocarbon-rich liquid to alter the viscosity of the slurry liquids and the flow characteristics of the slurry. Advantageously, the pyrolysis gases are "sweetened" prior to being marketed or used in the process. The elimination of potential pollutants in this manner not only enhances the value of the char and liquid organic fraction as non-polluting fuels but also improves the economics of the process as the gaseous products may be captured and marketed or utilized in the process. In accordance with a preferred embodiment, these gases are used primarily to produce lower chain alcohols which are admixed with the liquid organic material to improve the viscosity characteristics of the liquid organic fraction.

BEST MODE FOR CARRYING OUT THE INVENTION

The general method of manufacture of the instant fuel system is fully set out in the parent application of which this is a continuation-in-part. The parent application discloses that the fuel system can be utilized as a fuel composition either directly as the solid/liquid slurry or as a system which is separable into its solid and liquid components, with each constituent useful independently as a fuel or, in the case of the liquid component, a feedstock. The parent discloses that hydropyrolysis, hydrotreating, solid sizing, suspension agents, and bimodal or trimodal packing can be utilized to effect and enhance rheological characteristics of the slurry. In the interest of brevity, that application has been incorporated herein.

In accordance with the preparation of the particulate coal char/liquid organic material slurry that is utilized in accordance with the instant invention, raw coal is continuously crushed to particles in the range of ½" to ¼" in diameter to produce a crushed coal product. Advantageously, the crushed coal is then washed and otherwise beneficiated by means well known in the art to remove inorganics. This process and the size of the coal particle to be beneficiated will be dependent on the rank of the coal, its agglomerating tendencies and the inorganic sulfur and ash content of the coal. The coal is preferably preheated to remove moisture and entrained gases which are advantageously used in the process. The crushed coal is then hydropyrolyzed under temperatures and pressures and in accordance with process conditions to produce a particulate coal char. The hydropyrolysis produces a particulate char portion and a liquid organic fraction. Advantageously, the char portion may be further beneficiated to remove inorganic pollutants and mechanically and thermally treated to size the particulate char product which is efficacious for bimodal and trimodal packing. The sized char mixture is then ready to be slurried.

The liquid organic fraction derived during the hydropyrolytic destructive distillation of the coal may be advantageously separated by fractional distillation into a higher boiling fraction containing the bulk of the nitrogen and a lower boiling fraction. The higher boiling fraction can be further hydrogenated to alter viscosity or sent to storage for use directly as a chemical reagent and feed stock. The lower boiling fraction is rendered substantially free of combined and entrained materials which, on combustion, would produce sulfur oxides, nitrogen oxides and like pollutants. The lower boiling fraction can be distilled to remove gasoline and other valuable hydrocarbon fractions which can be used directly as transportation fuels.

The remaining lower boiling fraction is added to the upper boiling fraction which has been hydrogenated and beneficiated for use as the medium to slurry the particulate coal char. The exact mixture of liquid to solid will depend on a number of factors such as the characteristics of the liquid-fueled combustion device in which it is to be used, the transportation medium limitations and the like. The rheological characteristics of the fluidic fuel system are varied as a function of the viscosity of the hydrocarbon liquid and the size distribution of the solid particulate as well as the loading of the solid in the slurry. By using the process parameters, including the rank of coal pyrolyzed, the method of pyrolysis and the process temperatures, as further described herein, the viscosity of the liquid is varied.

The coals that can be employed are, generally, any coal which will undergo hydropyrolytic destructive distillation to form a particulate coal char. In accordance with one aspect of the instant invention where the slurry liquid organic fraction is derived from the hydropyrolysis, it will be realized by the skilled artisan that coals having lower percentages of volatiles will require use of alcohols or other "make-up" hydrocarbons to produce the pipeline transportable compositions having desirable rheology characteristics. Preferably, coal from the lignite rank to the medium volatile bituminous have sufficient volatiles so as to minimize make-up hydrocarbons. Additionally, use of the steam pyrolysis technique as disclosed herein, increases liquid yield as well as lowering the viscosity of such liquids. When lignites are utilized, they are advantageously subjected to pretreatment to remove residual water. Lignites are an advantageous starting material for the instant invention in that they contain process water for hydropyrolysis as well as volatiles up to 55% by weight (on a dry basis). This is advantageous in producing char slurries having higher liquid content with lower viscosity liquids.

The physical properties of the coal are also important in the practice of the instant invention. Those coals known as caking or agglomerating coals tend to form "cokes". Other coals of higher rank have plasticity and free swelling characteristics which tend to cause them to agglomerate and slake during the hydropyrolysis process. These coals must be subjected to special charring and treatment conditions as further set out herein to produce the particulate coal char suitable for use in accordance with the instant invention.

The mining and preparation of coal is fully described in Kirk-Othmer ENCYCLOPEDIA OF CHEMICAL TECHNOLOGY, second edition, Anthony Standin, editor, Interscience Publishers, New York, 1969, vol. 5, pp. 606–676. The coal is mined from a coal mine by either strip or underground methods as appropriate and well known in the art.

The raw coal is preferably subjected to preliminary crushing to reduce the particle size. Particle sizes of from ¼" to about ½" in lateral dimension (diameter) are found useful but the actual sizing is dependent on the properties of the coal as well as the need for beneficiation. The need for size reduction and the size of the reduced material will depend upon the process conditions utilized as well as the composition and rank of the coal material. When beneficiation is necessary, for example, with coals containing a high percentage of ash or inorganic sulfur, the coal is preferably ground and subjected to washing and beneficiation techniques. When coals are used which have agglomerating tendencies, the size of the coal must be matched to the hydropyrolysis techniques and process conditions in order to produce a particulate coal char and to prevent slagging and/or agglomeration during hydropyrolysis. The crushing and/or grinding is preferably accomplished with impact mills such as counter-rotating cage mills, hammer mills or the like. The crushed coal is sized by, for example, rough screening and gangue material is removed to assure a more uniform product for hydropyrolysis. Advantageously, carbonaceous fines and the like are readily utilized and subjected directly to hydropyrolytic destructive distillation.

In accordance with the aspect of the instant invention relating to reducing viscosity of the organic liquid through utilization of specific process parameters, the crushed coal particles are passed continuously through a preheater, which is operated in the range of from about 100° C. to about 220° C. at pressures from 0.1 atmospheres to 20 atmospheres in order to remove gases and moisture. In the case of coals of particular rank, vacuum and/or mechanical treatment have been found desirable for removal of water and entrained substances. The moisture is used as process water for the hydropyrolysis and/or hydrotreating steps as further set forth herein. The entrained gases which are removed have further value as fuel in the process or a hydrogen source for the hydropyrolysis step or as a feedstock for production of lower chain alcohols which are used to further reduce viscosity. Advantageously, the preheating is carried out using process heat from the char and hot gases liberated during pyrolysis. The preheating is preferably done at lower temperatures to minimize slagging and agglomeration.

Hydropyrolysis, as used herein, means the destructive distillation of coal in the absence of oxygen but in the presence of one or more hydrocarbon donors or hydrogen itself. "Hydropyrolysis" thus includes steam pyrolysis as well as hydrocarbonization techniques under varying temperature and pressure and atmosphere conditions such as, for example, in the presence of hydrogen, water vapor or hydrogen-donating material. The hydropyrolysis step of the instant invention can be carried out by any pyrolysis apparatus, which is well known in the art, having the ability to reach charring temperatures in the requisite time. For example, with subbituminous coals, temperatures should be in the range of from about 400° C. to about 800° C. and a heating rate of from about 1.5° C. per second to about 2.5° C. per second should be employed. Coals of higher rank require progressive heating at rates which prevent agglomeration and at higher final temperatures in the range of 1000° C. depending on the atmospheric pressures. It will be realized by the skilled artisan that, depending on the composition of the charge, the residence time, the pyrolysis process used and the charring furnace utilized, the temperatures and rates may vary. The temperatures and heating rates are also important in determining the viscosity of the liquid. Preferably, the hydropyrolysis is performed in a continuous process.

As the crushed coal is heated in the absence of oxygen, the entrained materials are vaporized and collected. Lower boiling organic fractions including hydrocarbons, cyclics, and aromatics as well as higher boiling organic fractions are emitted from the coal leaving a particulate char material of essentially carbon which is of a porous structure and substantially spherical in shape. Included in the emitted constituents are the nitrogen containing polluting compounds such as pyridine, piperazine and the like.

The preferred method of hydropyrolysis for varying the viscosity and increasing the liquid content is carried out in the presence of water and a hydrogen source such as the hydropyrolysis gases which have been subjected to standard phase shift reactions. In accordance with this preferred embodiment, steam pyrolysis is used. Steam pyrolysis is preferred in that it offers the greatest flexibility in varying liquid amount and viscosity. In a greatly preferred embodiment, a presoak step is used to liberate volatiles. It has been found advantageous in increasing liquid yield and reducing viscosity to subject the coal to pretreatment by holding the coal in the presence of an atmosphere having a substantial partial pressure of steam, and preferably a water saturated atmosphere, at pressures of from about 20 to about 60 atmospheres for resident times in the range of from 15 to about 45 minutes with 30 minutes being preferred, at temperatures in the range of from about 200° C. to about 400° C. and preferably from about 240° C. to about 320° C. This is followed by hydropyrolysis at the same steam pressures and temperatures of from about 400° C. to about 1000° C. with temperatures in the range of from about 600° to about 800° C. being preferred for subbituminous coals. The hydropyrolysis is preferably carried out in the presence of hydrogen. By a mechanism which is not fully understood, the steam pretreatment appears to enhance the hydropyrolization step increase the liquid yield and reduce liquid viscosities as well as enriching the hydrocarbon partial pressure of the liberated gases. Thus the exact temperatures and times required in the use of this method will be determined by the rank of the coal to be used as well as the rheology of final slurry product desired. In this manner the viscosity and percent loading of the slurry can be matched to the characteristics of the transportation as well as the end-use combustion systems, i.e., the rheology can be varied.

A hydrotreating step can be used to further reduce the viscosity of the liquid organic fraction. Thus, part or all of the liquid organic fraction can be further reduced in viscosity in order to vary the rheological characteristics of the slurry. The liquids hydrotreating step is quite well developed. A number of such technologies are readily available in the art. The hydropyrolysis/hydrotreater is preferable for further treating the liquid organic fraction to adjust viscosity since it allows the sequential hydropyrolysis of coal and hydrotreating of the liquid. In each case, the paramount consideration is to obtain a maximum amount of liquids having a viscosity consistent with producing a slurry that is capable of pipeline transport and of loading a maximum of a particulate solid coal char while being combustible in liquid-fueled combustion systems.

In practicing the process of the instant invention in a continuous mode, it has been determined that recycling the hot char to the hydropyrolyzer conserves energy and has a beneficial effect on the pyrolysis products. The reactor temperature and the residence time are variable factors used to produce greater yields of char and/or liquid organic material, as well as obtaining a hydrocarbon mix of desirable viscosity. The process can be "fine tuned", depending on which slurry factors are more important and on the rank of the coal (i.e., percent volatiles, agglomeration, etc.). For example, if some of the particulate char is to be separated at the destination for use as a solid fuel in solid-fueled combustion devices, higher loading factors may be desired in order to maximize the transportation of solid char.

If the slurry is to be fired directly into a liquid fueled combustion device, the loading and the liquid organic constituents and the viscosity of the liquids may be varied to maximize combustion efficiency, and, in some cases, amounts of alcohol and "make up" hydrocarbon distillates can be added. This enhances combustion characteristics in a particular combustion system configuration as well as rheology characteristics of the slurry. Liquid petroleum distillates which can be used include fractions from petroleum crudes or any artificially produced or naturally occurring hydrocarbon compound which is compatible with the coal-derived liquid organic hydrocarbon containing portion used as the slurry medium in accordance with the instant invention. These would include, without limitation, the aliphatic, cyclo-aliphatic and aromatic hydrocarbons, heterocyclics and phenols as well as multi-ring compounds, aliphatic-substituted aromatics and hydroxy-containing aliphatic-substituted aromatics. The aliphatics disclosed herein are intended to include both saturated and unsaturated compounds and their stereo-isomers. Particularly preferred are the lower chain alcohols including the mono-, di- and trihydroxy compounds. Preferably, the make-up hydrocarbons do not contain mercaptal, sulfate, sulfite, nitrate, nitrite or ammonia groups.

The char may be efficaciously sized and beneficiated. It is very important, in order to obtain the requisite liquid/solid mixture having the desired rheological characteristics, that the coal char be discrete, particulate char. When utilizing agglomerating or "caking" coals, preferably the process parameters are regulated so as not to produce an agglomerated product as previously set forth herein. Further, the coal char material may be emitted from the charring apparatus as discrete particles which are stuck together depending on the starting material and the pyrolysis conditions utilized. Therefore, the char material is ground to yield the substantially spherical, properly sized particulate coal char. Any conventional crushing and grinding means, wet or dry, may be employed. This would include ball grinders, roll grinders, rod mills, pebble mills and the like. Advantageously, the particles are sized and recycled to produce a desired distribution of particles. This is a very important aspect of the instant invention. The char particles are of sufficient fineness to pass a 100 mesh screen and the majority of the particles pass a 300 mesh screen. The mesh sizes refer to the Tyler Standard Screens. In accordance with the instant invention, char particles in the 100 mesh range or less are preferable. It will be realized that the particulate char of the instant invention having particle sizes in the above range is important to assure not only that the solid is high in reactivity, but also that the slurry is stable and can be pumped as a fluidic fuel directly into combustion systems. The exact distribution of particle sizes is somewhat empirical in nature and depends upon the characteristics of the liquid organic fraction. The rheological characteristics of the slurry are interdependent upon the viscosity of the slurry liquid and the particle size distribution of the char.

The ground, beneficiated char can be sized by any apparatus known in the art for separating particles of a size on the order of 100 mesh or less. Economically, screens or sieves are utilized, however, cyclone separators or the like can also be employed. In sizing, selections are made so as to assure a stable, pipeline transportable slurry and uniform combustion. A distribution of particle size is chosen to effect so called "modal" packing. The spheroid shape of the primary particle provides spacing or voids between adjacent particles which can be filled by a distribution of second or third finer particle sizes to provide bimodal or trimodal packing. This modal packing technique allows addition of other solid fuel material such as coal to the slurry without affecting the very advantageous rheology characteristics of the particulate coal char/liquid organic fraction slurry of the instant invention. Additionally, this packing mode allows the compaction of substantially more fuel in a given volume of fuel mixture while still retaining good fluidity.

The char may be beneficiated. When beneficiation is indicated because of the inorganics present, beneficiation may be utilized to clean either the coal or the char. The beneficiation can be performed by any device known in the art utilized to extract pollutants and other undesirable inorganics such as sulfur and ash. The char has a high degree of porosity which enables it to be readily beneficiated. Beneficiation may be accomplished, for example, by washing, jigging, extraction, flotation, chemical reaction, solvent extraction, oil agglomeration (for coal only) and/or electro-static separation. The latter three methods remove both ash and pyritic (inorganic) sulfur. When the solvent extraction or oil agglomeration methods are used, it is most advantageous to utilize, as the beneficiating agent, the liquid derived from the hydropyrolysis process. The exact method employed will depend largely on the coal utilized in forming the char, the conditions of hydropyrolysis, and the char size and porosity.

The chars which can be utilized in accordance with the instant invention have a high reactivity and surface area, providing excellent Btu to weight ratios. They are particulate in nature as distinguished from the larger, "structured" particles of the prior art. The char particles are sufficiently porous to facilitate beneficiation and combustion but the pore size is not so large as to require the use of excessive liquid for a given amount of solid. The spherical shape allows adjacent particles to "roll over" one another, therefore improving slurry rheology and enhancing the solid loading characteristics. Preferably, chars that can be employed are discrete spherical particles which typically have a reaction constant of from about 0.08 to about 1.0; a reactivity of from about 10 to about 12; surface areas of from about 100 microns to about 200 microns; pore diameters of from about 0.02 milimicrons to about 0.07 milimicrons; and pass 100 mesh, and preferably, 200 mesh.

The resultant sized, particulate coal char mix may be conveyed by means, of, for example, an air condult to be "slurried" in appropriate proportion with the organic fraction.

The liquid organic fraction may be hydrotreated and/or beneficiated, as necessary, to provide a lower viscosity, pollutant free, hydrocarbon containing organic fraction. The exact amount of this fraction utilized will depend upon the properties of the combustible particulate coal char-containing admixture which are desired. Normally, fractions having boiling points of about 200° F. have been found useful for the instant invention. In accordance with a greatly preferred embodiment, the low boiling transportation fuels such as aviation gasoline, kerosene, naptha and the lighter diesel fuels are separated from the liquid organic fraction prior to slurrying with the particulate coal char. These transportation fuels, which are pipeline transportable, can be marketed separately, thereby greatly improving the economics of the process.

The higher boiling fractions of the liquid organic fraction may contain certain sulfur and nitrogen compounds. This fraction may be removed by fractional distillation and used directly as a feedstock for chemical synthesis. Alternatively, it may be hydrotreated and beneficiated by methods well known in the art to reduce the viscosity and remove pollutants. Thus this liquid organic fraction is available as additional slurry liquid. Advantageously, the hydropyrolysis and hydrotreating can be accomplished sequentially, followed by beneficiation in accordance with the procedure previously disclosed herein.

The particulate char and the lower viscosity pollutant-free organic fraction and the hydrotreated higher boiling fraction are admixed in the desired portion to form a slurry. An admixture is thus formed of a particulate coal char and the organic liquid constituent having a ratio of particulate char to liquid which is dependent upon the properties of the slurry desired.

The terms "slurry" or "liquid/solid mixture" as used herein are meant to include a composition having an amount of the particulate coal char which is in excess of that amount which is inherently present in the liquid organic portion as a result of the hydropyrolysis process. For most applications, however, the particulate coal char constituent should comprise not less than about 45% by weight of the composition and preferably from about 45% to about 75% by weight. In accordance with one aspect wherein the char is separated from the liquid at the slurry destination, the term 'slurry' is intended to include a composition containing amounts of char as low as 1% by weight, which composition may be further transported, for example by pipeline, to a refinery or to another combustion facility.

In accordance with another aspect of the instant invention, particulate char produced from certain ranks of coal have pore sizes and absorption characteristics such as to require treating of the char prior to slurrying of the particulate char with the liquid to reduce absorption by the char of the liquid phase. This treatment serves to stabilize the rheology characteristics of the slurry and prevent absorption by the particulate char of an excess of the slurry liquids. In accordance with the instant invention, prevention of excessive absorption of slurry liquid by the char is necessary to prevent instability of rheology characteristics. When absorption rates by the char are in excess of from about 10% to about 15%, pretreatment is very beneficial. In accordance with this pretreatment, the char is brought into intimate contact with an amount of a the coating or "sealing" material effective to reduce the absorption of liquid by the char. The treatment is effected prior to the particulate char being slurried with the liquid. The sealants or coatings that are useful include organic and inorganic materials which will not produce pollutants upon combustion nor cause polymerization of the liquid slurry. Since surfactants and emulsifiers are used to enhance slurry stability, care must be taken that the coating or sealant is compatible with the stabilized composition. Sealants and coating materials which are particularly advantageous include parafins and waxes as well as the longer chain aliphatics, aromatics, polycyclic aromatics, aro-aliphatics and the like. Mixtures of various hydrocarbons, such as #6 fuel oil, are particularly desirable because of their ready availability and ease of application. Advantageously, the higher boiling liquid organic fractions from the hydropyrolysis of the coal are utilized. The sealant or coating can be applied to the char by spraying, electrostatic deposition or the like. In this manner, one can enhance the rheological stability of the slurry.

In accordance with another embodiment of the instant invention, coal and water, or more preferably the hydropyrolysis gases, are utilized to produce methanol and other lower chain alcohols which are utilized as the liquid phase for the combustible fuel admixture to adjust liquid viscosity and enhance slurry rheology characteristics. Water released from the coal during preheating can be used as part of the water required in the synthesis, thus further preserving precious resources.

As used herein the term alcohol is employed to mean alcohols (mono-, di- and trihydroxy) which contain from 1 to about 4 carbon atoms. These include, for example, methanol, ethanol, propanol, butanol and the like. The alcohol may range from substantially pure methanol to various mixtures of alcohols as are produced by the catalyzed reaction of gases from hydropyrolysis or natural gas. Advantageously, the alcohol constituent can be produced on site at the mine in conjunction with the hydropyrolytic destructive distillation. The process heat can be supplied from the hydropyrolysis step.

In accordance with the process for making these alcohols directly from coal and steam, carbon monoxide and hydrogen are initially formed in accordance with equation I:

$$\text{HOH (steam)} + \text{C (coal)} \rightarrow \text{CO} + \text{H}_2 \qquad \text{I.}$$

A portion of the gas is subjected to the shift reaction with steam to produce additional hydrogen in accordance with equation II:

$$\text{CO} + \text{HOH (steam)} \rightarrow \text{CO}_2 + \text{H}_2 \qquad \text{II.}$$

The $CO_2$ is scrubbed from the gaseous product leaving only hydrogen. The hydrogen is admixed with gaseous products of equation I. to produce a gas having desired ratio of hydrogen to carbon monoxide from which methanol and similar products are synthesized catalytically. Preferably, the gas having the desired ratio of hydrogen to carbon monoxide is produced during the coal hydropyrolysis. In accordance with this aspect of the instant invention, the raw hydropyrolysis gas which contains water vapor is subjected to sulfur and nitrogen removal as previously disclosed. The $H_2$ and CO are then separated by, for example, cryogenic means and converted to methane. The methane, ethane and higher hydrocarbon gases are converted to the alcohols.

In the methanol synthesis plant the respective constituents, such as carbon monoxide and hydrogen, are combined to produce methanol. The synthesis of methanol is described in page 370–398 of vol. 13 of the above referenced KIRK-OTHMER ENCYCLOPEDIA. The carbon monoxide and hydrogen are controlled in a ratio and temperature pressure combination to obtain maximum yields of the methanol fuel product. Other methods for methanol synthesis at lower temperatures and pressures are also known, as for example, the ICI low pressure process as described in "Here's How ICI Synthesizes Methanol at Low Pressure", Oil and Gas Journal, vol. 66, pp. 106–9, Feb. 12, 1968. In accordance with this aspect of the instant invention, the alcohol is used as a portion or substantially all of the liquid phase in the slurry. In this manner, the rheology characteristics can be further varied.

The mixing (or slurrying) of the solid particles and the liquid can be accomplished by any well known mixing apparatus in which an organic liquid constituent and a particulate coal char can be mixed together in specific proportion and pumped to a storage tank. Advantageously, emulsifying techniques are used, such as high speed empellers and the like. The method of slurrying, and especially emulsifying, will vary the rheology characteristics of the slurry. Unlike coal/water slurries and coal/oil mixtures as boiler feeds, the fuel of the instant invention is transportable by pipeline and therefore does not require slurrying equipment at the end-use facility. Thus, even small process heat systems can utilize the fuel of the instant invention efficiently and economically.

The important rheological aspect of the slurry in the instant application is that it is pumpable and stable. This is accomplished by matching the size of the solid char particle, the viscosity of the liquid phase and the stabilizer. Preferably, a small percentage by weight, for example from 1% to about 3%, of water is admixed into the slurry. This is especially preferable when surfactants which have hydrophyllic moieties are used. The slurry is preferably agitated or blended to produce a suspensoid which is stable under shear stress, such as pumping through a pipeline.

It will be realized that, in accordance with the instant invention, surfactants, suspension agents, organic constituents and the like may be added depending on the particular application. Certain well known surfactants and stabilizers may be added depending on the viscosity and non-settling characteristics desired. Examples of such substances which are useful in accordance with the instant invention include dry-milled corn flour, gelatinized corn flour, modified cornstarch, cornstarch, modified waxy maize, guar gum, modified guar, polyvinyl carboxylic acid salts, zanthum gum, hydroxyethyl cellulose, carboxymethyl cellulose, polyvinyl alcohol and polyacrylamide. As hereinbefore mentioned, advantageously the admixture of the instant invention demonstrates high fluidity. Thus a high Btu per unit volume mixture is obtained with lower viscosities and higher fluidities. It is important for the skilled artisan to understand that certain of the well known stabilizers create adverse rheological characteristics. Although no fixed rule can be set, those substances which tend to form gelatinous mixtures tend to cause dilatant behavior.

As previously set forth, the sizing and packing of the slurry is particularly important in obtaining a highly loaded, stable, transportable combustion fuel. It has been found advantageous to have greater than about 50% of the solid material smaller than about 100 mesh (Tyler) and over about 80% of that passing a mesh size in the range of 300 (Tyler). Preferably, the viscosity of the liquid organic fraction is in the range of from 17° API to about 20° API. This will of course depend on the loading and pumping characteristics desired, the stabilizers used, whether coal and/or alcohol are present in the slurry in accordance with the instant invention. The degree API is very important in the end use application, i.e., the combustion system design. Those oil fired systems designed for "heavier" crudes will tolerate more viscous oils and higher loaded slurries.

While the invention has been explained in relation to its preferred embodiment it is understood that various modifications thereof will become apparent to those skilled in the art upon reading the specification and the invention is intended to cover such modifications as fall within the scope of the appended claims.

What is claimed is:

1. A method of varying the rheology of a combustible, substantially non-polluting, fluidic fuel system comprising a portion of a particulate coal char dispersed in an amount of a liquid material effective to produce a transportable, liquid/solid mixture, wherein said liquid material is at least partially derived from the pyrolysis of coal comprising the step of varying the viscosity of said liquid material.

2. The method of claim 1 wherein said varying step is accomplished by varying the reaction conditions and hydrogen concentration during pyrolysis of said coal.

3. The method of claim 1 whrein said varying step is accomplished by admixing with said liquid material a lower chain alcochol of from 1 to about 4 carbon atoms.

4. The method of claim 3 wherein said lower chain alcohol is derived from the catalyzed reaction of coal derived gas or natural gas.

5. The method of claim 4 wherein said gas is at least partially derived from the hydropyrolysis of coal.

6. The method of claim 2 wherein said pyrolysis is hydropyrolysis and is carried out by subjecting coal to a preheating step at temperatures of from about 100° C. to about 220° C. at pressures of from about 0.1 to about 20 atmospheres prior to said hydropyrolysis.

7. The method of claim 6 comprising the further step of presoaking said coal in the presence of a saturated steam atmosphere at atmospheres of from about 40 to 60 atmospheres and at temperatures in the range from about 200° C. to 400° C. subsequent to the preheating step and prior to said hydropyrolysis step.

8. The method of claim 1 wherein said varying step is accomplished by hydrotreating said liquid material.

9. The method of claim 1 comprising the further step of varying the loading of said particulate coal char in said liquid material.

10. The method of claim 1 comprising the further step of varying the size distribution of the particulate coal char.

11. The method of claim 1 comprising the further step of processing said particulate coal char to effect bimodal or trimodal packing.

12. A method for varying the rheology of a combustible, substantially non-polluting fluidic fuel system which comprises a portion of a particulate coal char dispersed in an amount of a liquid material effective to produce a transportable, liquid/solid mixture, wherein said liquid material is at least partially derived from the pyrolysis of coal, comprising the steps of (a) subjecting coal to hydropyrolytic destructive distillation in the absence of oxygen but in the presence of a hydrogen-donating compound to produce a coal char, a pyrolysis liquid and a hydrocarbon containing gas, to vary the viscosity of the liquid organic containing material;

(b) processing the coal char to produce a particulate coal char;

(c) admixing said particulate coal char and said liquid to form said combustible fluidic fuel system.

13. The method of claim 12 wherein said hydrogen-donating compound is selected from the group consisting of water, hydrogen-donating compounds and hydrogen.

14. The method of claim 12 further comprising the steps of beneficiating said liquid and said solid prior to performing said admixing step.

15. The method of claim 12 wherein hydropyrolysis is carried out by subjecting coal to a preheating step at temperatures of from about 100° C. to about 220° C. at pressures of from about 0.1 to about 20 atmospheres prior to said hydropyrolysis.

16. The method of claim 15 comprising the further step of presoaking said coal in the presence of a saturated steam atmosphere at atmospheres of from about 40 to 60 atmospheres and at temperatures in the range from about 200° C. to 400° C. subsequent to the preheating step and prior to said hydropyrolysis step.

17. The method of claim 12 further comprising the step of coating said solid prior to performing said admixing step with an amount of a sealant material effective to substantially diminish the absorption of said liquid by said solid.

18. The method of claim 12 wherein said organic liquid further comprises a portion of an alcohol having from about 1 to about 4 carbon atoms.

19. The method of claim 18 wherein alcohol is produced by catalytic synthesis of said gas.

* * * * *